United States Patent [19]

Iio et al.

[11] Patent Number: 4,776,778

[45] Date of Patent: Oct. 11, 1988

[54] REFRIGERANT COMPRESSOR WITH SHAFT BEARING HAVING IMPROVED WEAR RESISTANCE

[75] Inventors: Masahiro Iio; Haruhiko Takada; Mitsuya Ono; Teruo Nakamura, all of Konan, Japan

[73] Assignee: Diesel Kiki Co., Ltd., Tokyo, Japan

[21] Appl. No.: 158,135

[22] Filed: Feb. 17, 1988

Related U.S. Application Data

[63] Continuation of Ser. No. 930,297, Nov. 13, 1986, abandoned.

[30] Foreign Application Priority Data

Nov. 20, 1985 [JP] Japan ..... 60-179467[U]

[51] Int. Cl.[4] ..... F04C 18/344; F04C 29/02; F04C 29/04

[52] U.S. Cl. ..... 418/84; 418/87; 418/94

[58] Field of Search ..... 418/84, 87, 94, 100, 418/102

[56] References Cited

U.S. PATENT DOCUMENTS

| | | | |
|---|---|---|---|
| 3,899,271 | 8/1975 | Glanvall | 418/102 |
| 4,144,002 | 3/1979 | Shibuya et al. | 418/100 |
| 4,391,573 | 7/1983 | Tanaka et al. | 418/94 |
| 4,484,868 | 11/1984 | Shibuya et al. | 418/102 |

FOREIGN PATENT DOCUMENTS

| | | | |
|---|---|---|---|
| 57-212391 | 12/1957 | Japan . | |
| 59-176492 | 10/1984 | Japan | 418/84 |
| 60-98187 | 6/1985 | Japan . | |
| 1386836 | 3/1975 | United Kingdom . | |

*Primary Examiner*—John J. Vrablik
*Assistant Examiner*—Leonard P. Walnoha
*Attorney, Agent, or Firm*—Frishauf, Holtz, Goodman & Woodward

[57] ABSTRACT

In a refrigerant compressor, a driving shaft is rotatably supported within a compressor housing by a bearing on a suction side. A trigger valve is provided in a passageway communicating a discharge pressure chamber with the bearing on the suction side. When pressure within the discharge pressure chamber is lower than a predetermined value, the trigger valve opens the passageway to permit gaseous refrigerant of high temperature within the discharge pressure chamber to be supplied to the bearing on the suction side.

6 Claims, 3 Drawing Sheets

REFRIGERANT COMPRESSOR WITH SHAFT BEARING HAVING IMPROVED WEAR RESISTANCE

This application is a continuation of application Ser. No. 930,297, filed Nov. 13, 1986, now abandoned.

BACKGROUND OF THE INVENTION

The present invention relates to refrigerant compressors and, more particularly, to a bearing lubricating structure of a refrigerant compressor, which intends to improve the wear resistance of a bearing, and its associated parts on a suction side of the compressor.

A vane compressor in general is simple in structure and suitable for high rotational speed operation, and has therefore widely been used as a refrigerant compressor in an air conditioning system for vehicles. The refrigerant compressor is one of components realizing a steam refrigerating cycle which employs, as operating fluid, refrigerant such as flon. The refrigerant compressor compresses the flon gas evaporated by an evaporator and supplies the compressed flon gas to a condenser by which the flon gas is condensed.

In the refrigerant compressor of the kind referred to above, the refrigerant contains lubricating oil for lubrication of various portions of the compressor. Recently, needle roller bearings are mainly employed as radial bearings for rotatably supporting a driving shaft, in order to improve their resistance to seizure.

However, if the refrigerant compressor is operated at idling for a long period of time while the air conditioning system is in a low thermal condition, the needle roller bearing on the suction side of the refrigerant compressor and its vicinity are subjected to low temperature and high pressure (35° to 36° C. and 8 atg, for example), so that the refrigerant around the needle roller bearing is in a wet or steamy state. Thus, the lubricating oil on the needle roller bearing is diluted with the wet or steamy refrigerant to be reduced in viscosity. FIG. 3 graphically shows a change in viscosity of naphthenic lubricating oil as an example, with the abscissa indicating the percentage of flon (R-12 according to Japan Industrial Standard) solved in the lubricating oil in terms of weight percent (Wt %), and the ordinate indicating the viscosity of the lubricating oil in terms of centistoke (cSt) and in logarithmic scale.

In general, the service life of a bearing of this kind depends upon the thickness of oil film thereon. Since the oil film thickness is in proportion to the 0.736th power of the viscosity of the lubricating oil, it is necessary to suppress or restrain the dilution of the lubricating oil with the wet or steamy refrigerant, in order to enhance the seizure resistance and wear resistance of the bearing and its peripheral parts for prolonging the service life of the bearing.

OBJECT AND SUMMARY OF THE INVENTION

It is an object of the invention to provide a refrigerant compressor which can improve the seizure resistance and wear resistance of a radial bearing supporting the driving shaft and its surrounding parts on the suction side.

According to the invention, there is provided a refrigerant compressor for use in an air conditioning system, comprising:

a compressor housing having a suction side and a discharge side;

a discharge pressure chamber defined within the compressor housing;

a driving shaft arranged at least in part within the compressor housing;

bearing means arranged within the compressor housing at the suction side thereof and rotatably supporting the driving shaft;

pumping means arranged within the compressor housing and rotatably driven by the driving shaft for compressing refrigerant and discharging the compressed refrigerant into the discharge pressure chamber;

communication passage means communicating the discharge pressure chamber with the bearing means; and trigger valve means arranged in the communication passage means and responsive to pressure within the discharge pressure chamber for selectively closing and opening the communication passage means;

wherein when the pressure within the discharge pressure chamber is lower than a predetermined value, the trigger valve means opens the communication passage means to permit refrigerant within the discharge pressure chamber to be supplied to the bearing means.

The above and other objects, features and advantages of the invention will become more apparent from the ensuing detailed description taken in conjunction with the accompanying drawings.

DETAILED DESCRIPTION

The invention will be described in detail with reference to the drawings showing a preferred embodiment thereof.

Figure 1:
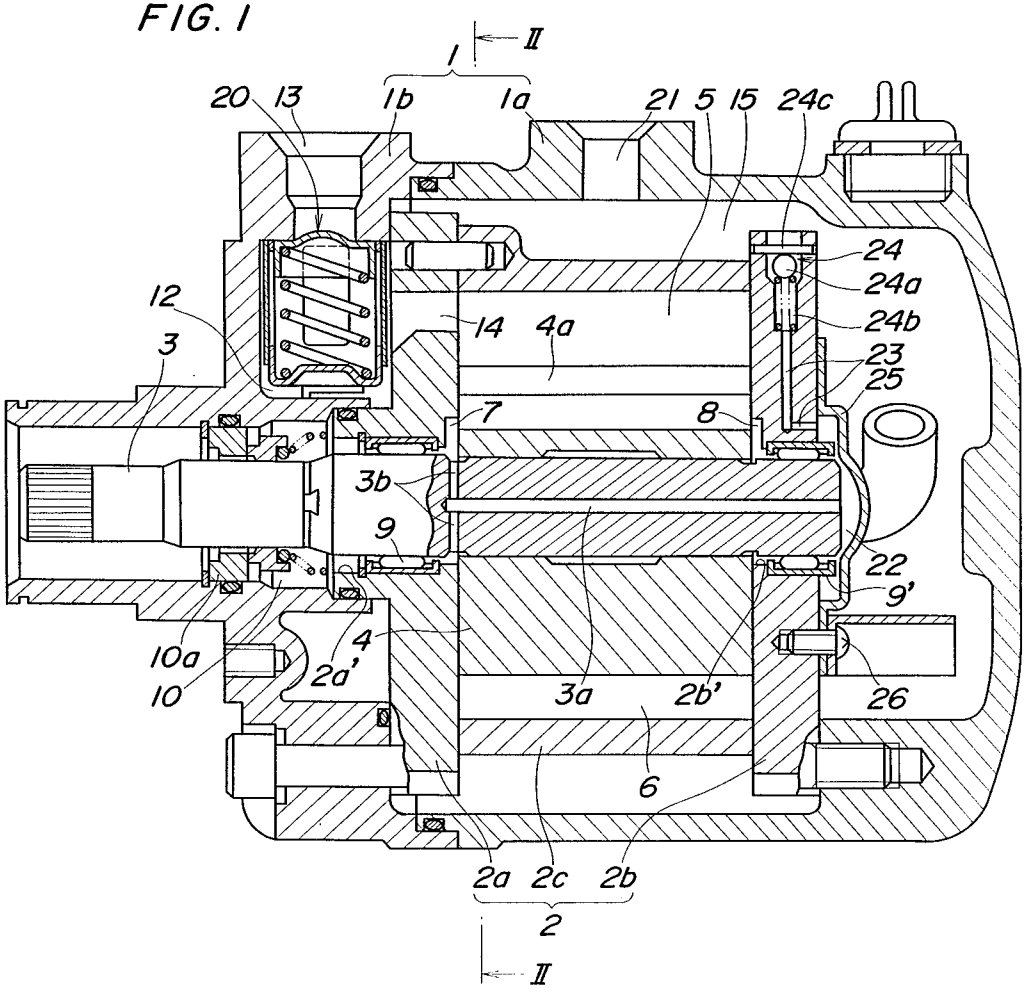
FIG. 1 is a longitudinal cross-sectional view showing a refrigerant compressor according to an embodiment of the invention.
Figure 2:
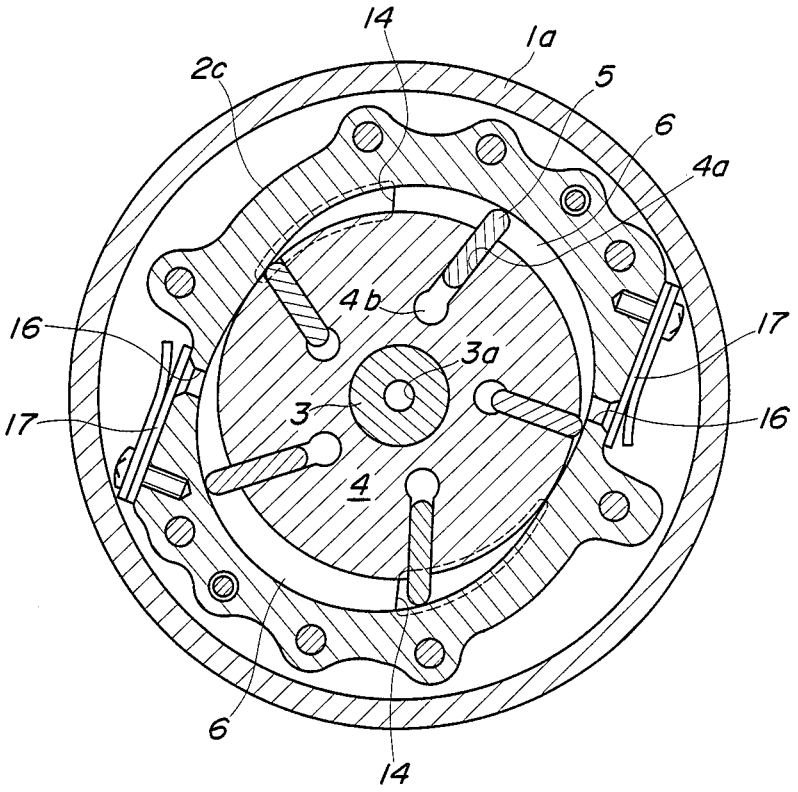
FIG. 2 is a transverse cross-sectional view taken along the line II—II in FIG. 1.
Figure 3:
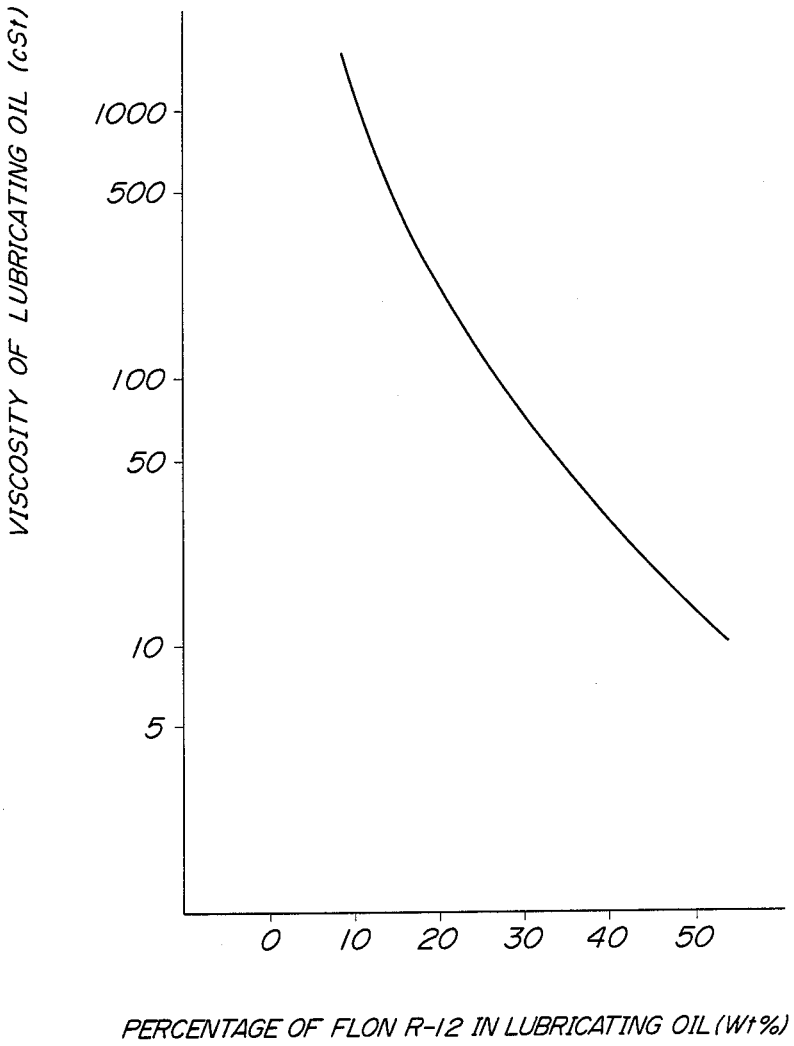
FIG. 3 is a graphical representation of a change in viscosity of lubricating oil relative to percentage of flon (R-12) solved in the oil.

Referring to FIGS. 1 and 2, a refrigerant compressor illustrated is a vane compressor which includes a compressor housing 1 comprised of a cylindrical casing 1*a* having a front open end and a rear closed end, and a front head 1*b* fitted in an airtight manner on the front open end of the cylindrical casing 1*a*. The compressor housing houses therein a pump housing 2 which is comprised of a front side block 2*a*, a rear side block 2*b*, with its opposite open ends closed by the side blocks 2*a*, 2*b*, and a cam ring 2*c*. Within the pump housing 2, a cylindrical rotor 4 is mounted on a driving shaft 3 for rotation therewith. The rotor 4 is provided therein with a plurality of (five in the illustrated embodiment) circumferentially equidistantly arranged slits 4*a* in each of which a corresponding one of plate-like vanes 5 is radially slidably fitted. Thus, a plurality of compression chambers 6 are defined each by the inner surfaces of the pump housing 2, the outer peripheral surface of the rotor 4 and corresponding adjacent ones of the vanes 5.

The driving shaft 3 axially extends through the front head 1*b*, and the front and rear side blocks 2*a*, 2*b*, and is rotatably supported by front and rear radial bearings 9 and 9′ formed of roller bearings, preferably needle roller bearings, which are mounted, respectively, in the front and rear side blocks 2*a* and 2*b*. A portion of the rotary shaft 3 which extends through the front head 1*b* is airtightly sealed by a shaft seal device 10*a* within a shaft seal chamber 10 defined within the front head 1*b*. The front side block 2*a* has an end surface facing toward the rear side block 2*b* and formed at a diametrically central portion thereof with an annular groove 7. Similarly, the rear side block 2*b* has an end surface facing toward the front side block 2*a* and formed at a diametrically central portion thereof with an annular groove 8. These annular grooves 7 and 8 communicate with vane back pressure chambers 4*b* which are formed respectively at radially inner ends of the respective slits 4*a*, and are continuous with respective bearing bores 2*a*' and 2*b*' formed, respectively, through the front and rear side blocks 2*a*, 2*b*.

A suction chamber 12 is formed in the front head 1*b* and defined by the front head 1*b* and the side block 2*a*, and a suction port 13 provided in an upper wall of the front head 1*b* opens into the suction chamber 12 through a check valve 20 arranged in the chamber 12. The suction chamber 12 is disposed to communicate, through a pair of inlet ports 14 and 14 formed in the front side block 2*a* at diametrically opposite locations, with compression chambers 6 which are on suction stroke.

A discharge pressure chamber 15 is formed within the compressor housing 1 and defined between outer surfaces of the pump housing 2 and inner surfaces of the compressor housing 1, and a discharge port 21 formed through an upper wall of the compressor housing 1 opens into the discharge pressure chamber 15. A pair of outlet ports 16 and 16 having respective discharge valves 17 and 17 are formed through the peripheral wall of the cam ring 2*c* and are disposed to communicate with compression chambers 6 which are on compression stroke.

The rear side block 2*b* is provided therein with a communication bore 23 communicating the discharge pressure chamber 15 with a sealing chamber 22 defined between the outer end surface of the rear roller bearing 9' and a cover member 25 attached to the outer end surface of the rear side block 2*b* by means of bolts 26, only one of which is shown. The communication bore 23 vertically extends from the outer peripheral surface of the rear side block 2*b* and has provided therein a trigger valve 24 at an enlarged upper end thereof, which opens the communication bore 23 only when thermal load on an air conditioning system in which the refrigerant compressor is incorporated is low. The trigger valve 24 is comprised of a ball valve body 24*a* movable within the communication bore 23 between an open position where the ball valve body 24*a* opens the communication bore 23 and a closed position where it closes the communication bore 23, a coiled spring 24*b* for urgingly biasing the ball valve body 24*a* towards the open position, and a stopper pin 24*c* traversing the communication bore 23 for preventing the ball valve body 24*a* from coming out of the bore 23. The trigger valve 24 is set such that when hydraulic pressure (discharge pressure) within the discharge pressure chamber 15 is lower than a predetermined value, the ball valve body 24*a* is urged by the force of the spring 24*b* into the open position, and when the hydraulic pressure is higher than the predetermined value, the ball valve body 24*a* is moved into the closed position against the force of the spring 24*b*.

In addition, the driving shaft 3 is formed therein with an axially extending central bore 3*a* which has one end thereof opening into the sealing chamber 22 and the other end terminating in the interior of the driving shaft 3 in communication with the annular bore 7 through a plurality of radial bores 3*b* formed in the driving shaft 3.

As the rotary shaft 3 is driven by an engine (not shown) or the like to rotate the rotor 4, tips of the vanes 5 are brought into tight sliding contact with the inner peripheral surface of the cam ring 2*c*. The compression chambers 6 on suction stroke are progressively increased in volume so that gaseous refrigerant is drawn through the suction port 13 into the compression chambers 6 through the suction chamber 12 and the inlet ports 14. The compression chambers 6 on compression stroke are progressively reduced in volume so that the refrigerant drawn into the compression chambers 6 is compressed therein. The compressed refrigerant within the compression chambers 6 on discharge stroke at the end of the compression stroke pushes and opens the discharge valves 17 and 17 through the outlet ports 16 and 16 and is discharged into the discharge pressure chamber 15 through the outlet ports 16 and 16. The compressed refrigerant thus discharged is delivered from the discharge pressure chamber 15 to a condenser (not shown) through the discharge port 21.

When the thermal load on the air conditioning system is high and the refrigerant discharged from the refrigerant compressor is high in pressure and temperature, there is no likelihood of wear of the roller bearing 9 on the suction side and its peripheral parts owing to dilution of lubricating oil by refrigerant, because on such occasion the roller bearing 9 on the suction side of the refrigerant compressor and its peripheral parts are supplied with refrigerant high in pressure and temperature, i.e. refrigerant in a superheated state. At this time, the pressure within the discharge pressure chamber 15 is higher than the predetermined or valve opening pressure value, and the trigger valve 24 closes the communication bore 23, as described above.

On the other hand, when the thermal load on the air conditioning system is low, if the refrigerant compressor is idling for a long period of time, the roller bearing 9 and its surrounding ports in the prior art arrangement are supplied with refrigerant in a wet or steamy state, often causing seizure of these parts as discussed previously. In the illustrated embodiment of the present invention, however, under this condition where the pressure within the discharge pressure chamber 15 is lower than the predetermined value, the trigger valve 24 opens the communication bore 23 to permit refrigerant gas high in pressure and temperature within the discharge pressure chamber 15 to be supplied to the annular groove 7 through the communication bore 23, the sealing chamber 22, and the bores 3*a* and 3*b* in the driving shaft 3, so that the refrigerant under the wet or steamy condition within the annular groove 7 is heated by the refrigerant gas of high temperature. By this heating, the roller bearing 9 and its surroundings are covered with the refrigerant gas under the superheated state, thereby preventing the lubricating oil on the roller bearing 9 and its associated parts from being reduced in viscosity. This enables the roller bearing 9 to be adequately lubricated, thus making it possible to enhance the seizure resistance and wear resistance of the roller bearing 9 and its associated parts, to thereby prolong the service life of the roller bearing 9.

Incidentally, it is not absolutely necessary to provide the above-described countermeasures for the roller bearing 9' on the discharge side because the roller bearing 9' and its surrounding parts are located near the discharge pressure chamber 15 and the lubricating oil here is always heated by the superheated refrigerant from the discharge pressure chamber 15 via the cover member 25. Moreover, according to the embodiment described above, since high pressure and high temperature refrigerant passes by the bearing 9' on the discharge side on its way to the bearing 9 on the suction side, the bearing 9' and its related parts can never undergo wear.

Although in the illustrated embodiment the communication bore 23 and the trigger valve 24 are provided in the rear side block 26, they may be provided in the front side block 2a in a similar arrangement to the illustrated embodiment, providing equivalent results to those described above.

What is claimed is:

1. A refrigerant compressor for use in an air conditioning system, comprising:

a compressor housing;

a discharge pressure chamber defined within said compressor housing;

a driving shaft arranged at least in part within said compressor housing and having a suction end and a discharge end, said compression housing having a suction side receiving the suction end of the driving shaft and a discharge side receiving the discharge end of the drive shaft;

bearing means arranged within said compressor housing at said suction side thereof and rotatably supporting said driving shaft;

pumping means arranged within said compressor housing and rotatably driven by said driving shaft for compressing refrigerant and discharging the compressed refrigerant into said discharge pressure chamber:

communication passage means communicating said discharge pressure chamber with said bearing means; and trigger valve means arranged in said communication passage means and responsive to pressure within said discharge pressure chamber for (a) opening said communication passage means when the pressure within said discharge pressure chamber during continuous compressor operation is lower than a predetermined value to supply high temperature refrigerant gas from said discharge pressure chamber to said bearing means which heats refrigerant that is in a wet or steamy condition during a low thermal load condition on the air conditioning system to thereby prevent lubricating oil on said bearing means from being diluted with refrigerant, and (b) for closing said communication passage means when the pressure within said discharge pressure chamber is higher than said predetermined value.

2. A refrigerant compressor as claimed in claim 1, including:

a pump housing arranged within said compressor housing;

said pumping means comprising a rotor mounted on said driving shaft within said pump housing for rotation therewith, and a plurality of vanes slidably mounted in said rotor;

wherein compression chambers are defined between said pump housing, said rotor, and adjacent ones of said vanes and vary in volume with rotation of said rotor for effecting suction or refrigerant, compression of the sucked refrigerant, and discharge of the compressed refrigerant into said discharge pressure chamber.

3. A refrigerant compressor as claimed in claim 2, wherein said pump housing comprises a front side block having said bearing means mounted therein at said suction side, a rear side block having second bearing means mounted therein at said discharge side, and a cam ring arranged between said front and rear side blocks, said rotor being mounted on a portion of said driving shaft extending between said front and rear side blocks within said cam ring, said communication passage means comprising first bore means formed in said rear side block, and second bore means formed in said driving shaft and in communication with said first bore means.

4. A refrigerant compressor as claimed in claim 3, wherein said trigger valve means is arranged in said first bore means, said trigger valve means comprising a ball valve body movable between a closed position where said ball valve body closes said first bore means and an open position where said ball valve body opens said first bore means, and spring means urging said ball valve body toward said open position.

5. A refrigerant compressor as claimed in claim 1, wherein said bearing means comprises a roller bearing.

6. A refrigerant compressor as claimed in claim 5, wherein said bearing means comprise a needle roller bearing.

* * * * *